US007335117B2

(12) United States Patent
Reason-Kerkhoff

(10) Patent No.: US 7,335,117 B2
(45) Date of Patent: Feb. 26, 2008

(54) SWING TRAINING DEVICE FOR SPORTS

(76) Inventor: Debra R. Reason-Kerkhoff, 1744 Sparkling Water Cir., Ocoee, FL (US) 34761

( * ) Notice: Subject to any disclaimer, the term of this patent is extended or adjusted under 35 U.S.C. 154(b) by 0 days.

(21) Appl. No.: 11/539,914

(22) Filed: Oct. 10, 2006

(65) Prior Publication Data

US 2007/0082760 A1 Apr. 12, 2007

Related U.S. Application Data

(63) Continuation-in-part of application No. 11/182,353, filed on Jul. 15, 2005, now Pat. No. 7,125,350.

(60) Provisional application No. 60/679,616, filed on May 10, 2005, provisional application No. 60/671,608, filed on Apr. 15, 2005.

(51) Int. Cl.
*A63B 69/00* (2006.01)

(52) U.S. Cl. ..... 473/452; 473/270; 473/217

(58) Field of Classification Search ..... 473/452, 473/272, 270, 217, 269, 532; D21/315, 780, D21/724

See application file for complete search history.

(56) References Cited

U.S. PATENT DOCUMENTS 2,189,613 A 2/1940 Paulsen
3,352,559 A 11/1967 Larsen
3,372,930 A * 3/1968 Sertich ..... 473/452
3,466,040 A 9/1969 Sertich
3,979,116 A 9/1976 Matchick
4,194,735 A 3/1980 Wilson
4,629,181 A 12/1986 Krive
4,932,656 A 6/1990 Pierce
5,037,094 A * 8/1991 Johnson ..... 473/452
5,318,290 A 6/1994 Sawyer
5,810,673 A 9/1998 Castleberry
5,976,026 A 11/1999 Erb (Continued)

OTHER PUBLICATIONS

Item TAH49 from on-line catalog www.baseballjunk.com/hittingaids.htm called "Stride Guide", photo and features list.

(Continued)

*Primary Examiner*—Eugene Kim
*Assistant Examiner*—M. Chambers
(74) *Attorney, Agent, or Firm*—David G. Maire; Beusse Wolter Sanks Mora & Maire, PA

(57) ABSTRACT

A device for practicing an address stance and ball-hitting motion in sports such as baseball, softball and tennis. A hitter stands on a step plate (30) and a swivel plate (31) mounted on a flat base (12). The plates have adjustable separation, with the step plate fixable in a plurality of locations relative to the swivel plate. The plates align the hitter's feet using toe stops (36). The step plate (30) has a foot guard (34) that forces the hitter to step toward the pitch. The swivel plate (31) rotates about a vertical axis, and has foot-retaining straps (38, 39) that allow the heel to lift. The hitter learns to step toward the ball and swivel the back foot while swinging, turning the body, and shifting weight toward the ball. The foot plates (30, 31) are reversible on the base (12) for right or left-handed use.

8 Claims, 8 Drawing Sheets

U.S. PATENT DOCUMENTS

| | | | | |
|---|---|---|---|---|
| 6,102,818 | A | 8/2000 | Hamilton | |
| 6,723,004 | B1 | 4/2004 | Florian | |
| 6,749,529 | B1 | 6/2004 | Sobolewski | |
| 7,125,350 | B1 * | 10/2006 | Reason-Kerkhoff | 473/452 |

OTHER PUBLICATIONS

Item TAH35 from on-line catalog www.baseballjunk.com/hittingaids.htm called "Pivot Pro", photo and brief description.

Item TAH55 from on-line catalog www.baseballjunk.com/hittingaids.htm called "Dewstep", photo and brief description.

* cited by examiner

SWING TRAINING DEVICE FOR SPORTS

RELATED APPLICATIONS

This application is a continuation-in-part of U.S. patent application Ser. No. 11/182,353 filed on 15 Jul. 2005, now U.S. Pat. No. 7,125,350, which in turn claimed benefit of the 15 Apr. 2005 filing date of U.S. provisional application 60/1671,608 and the 10 May 2005 filing date of U.S. provisional application 60/679,616. This application also claims benefit of the 13 Apr. 2006 filing date of international application PCT/US2006/014035.

FIELD OF THE INVENTION

This invention relates to the field of training aids for batting a ball, and especially to devices for training the foot positions and body movements for batting a ball such as a baseball or softball.

BACKGROUND OF THE INVENTION

Numerous bat swing training aids have been devised for softball and baseball. Some of these include plates or mats placed on the ground beside a home plate, with foot placement indications for an address stance and swing stride. These aids vary in emphasis, mode of enforcement, intended result, safety, and other factors. However, none of them combines an ideal training result with safety, convenience, and practicality in the same way and to the same degree as the present invention.

For example, a product called "stride guide" is a flat plate with foot placement and stride indicators and a rotating disk for the ball of the back foot. It has a raised edge behind the disk to enforce lifting of the back heel, thus shifting the user's weight forward. It has other raised edges to limit the stride of the lead foot. However, it does not require the user to step with the lead foot, rather than slide, it does not physically set both feet in toe alignment for the address stance, it does not physically align the lead foot perpendicularly to the pitch, it does not physically set the address stance width, it does not retain the back foot, and it does not limit the pivot range of the back foot.

The present inventor feels that physical enforcement of address stance and stepping into the swing provides more definitive training and faster coaching than visual indicators alone, and that these physical enforcements make a stronger impression on a user's "muscle memory". She also feels that physical limits on the back foot pivot range are important, both for training and safety,

BRIEF DESCRIPTION OF THE DRAWINGS

The invention is explained in following description in view of the drawings that show.

DETAILED DESCRIPTION OF THE INVENTION

The inventor recognized that a better training aid would be useful in instructing hitters such as baseball, softball and tennis players during practice to align their feet in the address stance, to avoid putting their feet too far apart, to lift the back heel, and to step toward the ball and shift their weight while swinging the bat or racquet. She devised a convenient and practical device for this purpose. In this description "front" or "forward" means toward the oncoming ball or ball pitcher or ball tee, "back" means away from the oncoming ball/pitcher/tee. Gender-specific pronouns are used for convenience only, and are intended to include both genders.

Figure 5:
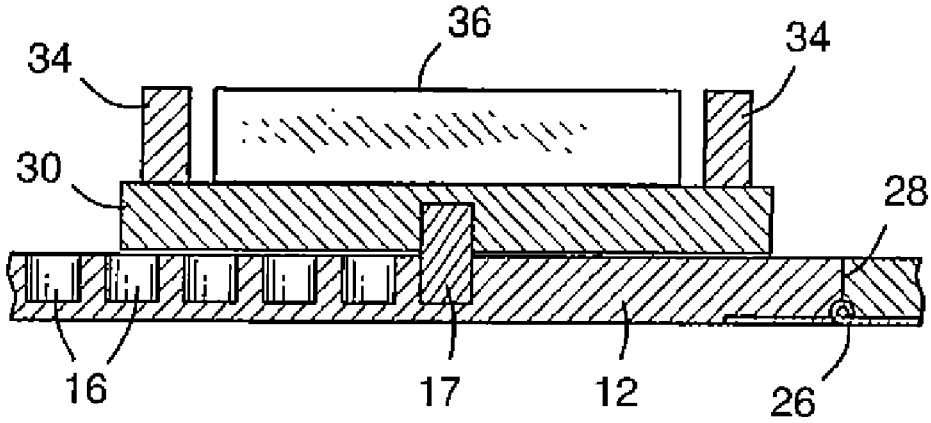
FIG. 5 is a sectional view taken along section line 5-5 of FIG. 3.
Figure 6:
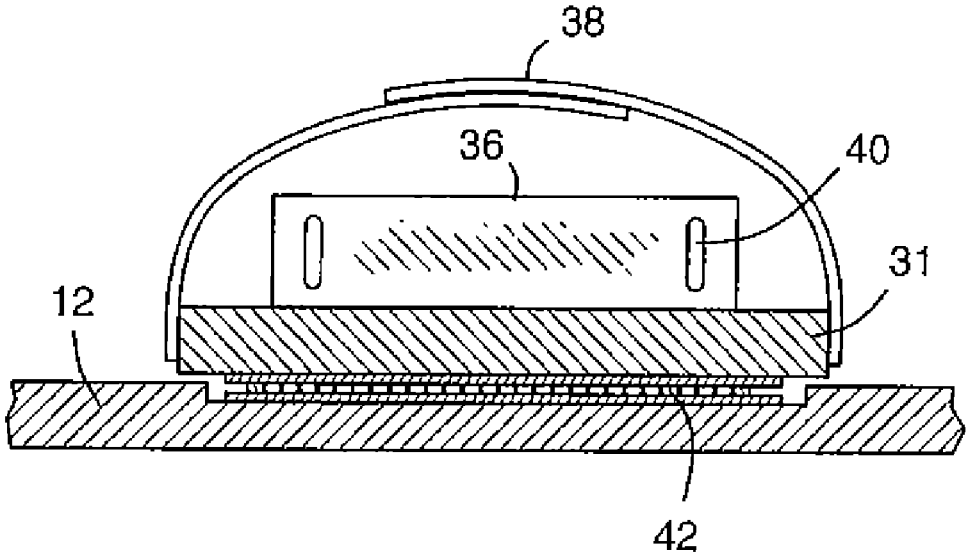
FIG. 6 is a sectional view taken along section line 6-6 of FIG. 3.

The drawings illustrate an embodiment of a device for training the foot positions and body motions for batting a ball such as a baseball during the address stance, swing, and follow-through. This embodiment is described as being used to hit a baseball being thrown by a pitcher, but it may be appreciated that the device may also be used to train a hitter for other sports such as tennis, etc. It teaches proper foot orientation and stance width, swing stride, shifting of body weight, and proper back foot pivot. It comprises a base plate 12 with anchor holes 14 for ground anchors 15. A step plate 30 for the lead foot comprises a traction surface 32, a raised toe stop 36, and two raised foot guards 34. The step plate 30 is mounted to the base plate 12 at a selectable position provided by pegs 17 in alternate peg holes 16 as seen in FIG. 5. A swivel plate 31 for the back foot comprises a traction surface 32, a raised toe stop 36, and foot restraint straps 38, 39 arranged to hold the ball of the foot on the plate while allowing the heel to lift. The swivel plate 31 is mounted on the base plate 12 by a bearing 42 that allows rotation of the swivel plate 31 about a vertical axis. The bearing 42 may be recessed in the base plate 12 as in FIG. 6 so that the top surfaces of the step plate 30 and the swivel plate 31 are at approximately the same height. As an example of bearing 42 a ring of ball bearings captured between two race plates can be used. The base plate 12 may be divided in half along a hinge line 28 connected by a hinge 26 for compact folding. It may further comprise a handle 29 on each half for convenient carrying of the folded device. The handles 29 may be on the ends of the base plate 12, as shown, or on other parts of the edge.

Figures 1, 2:
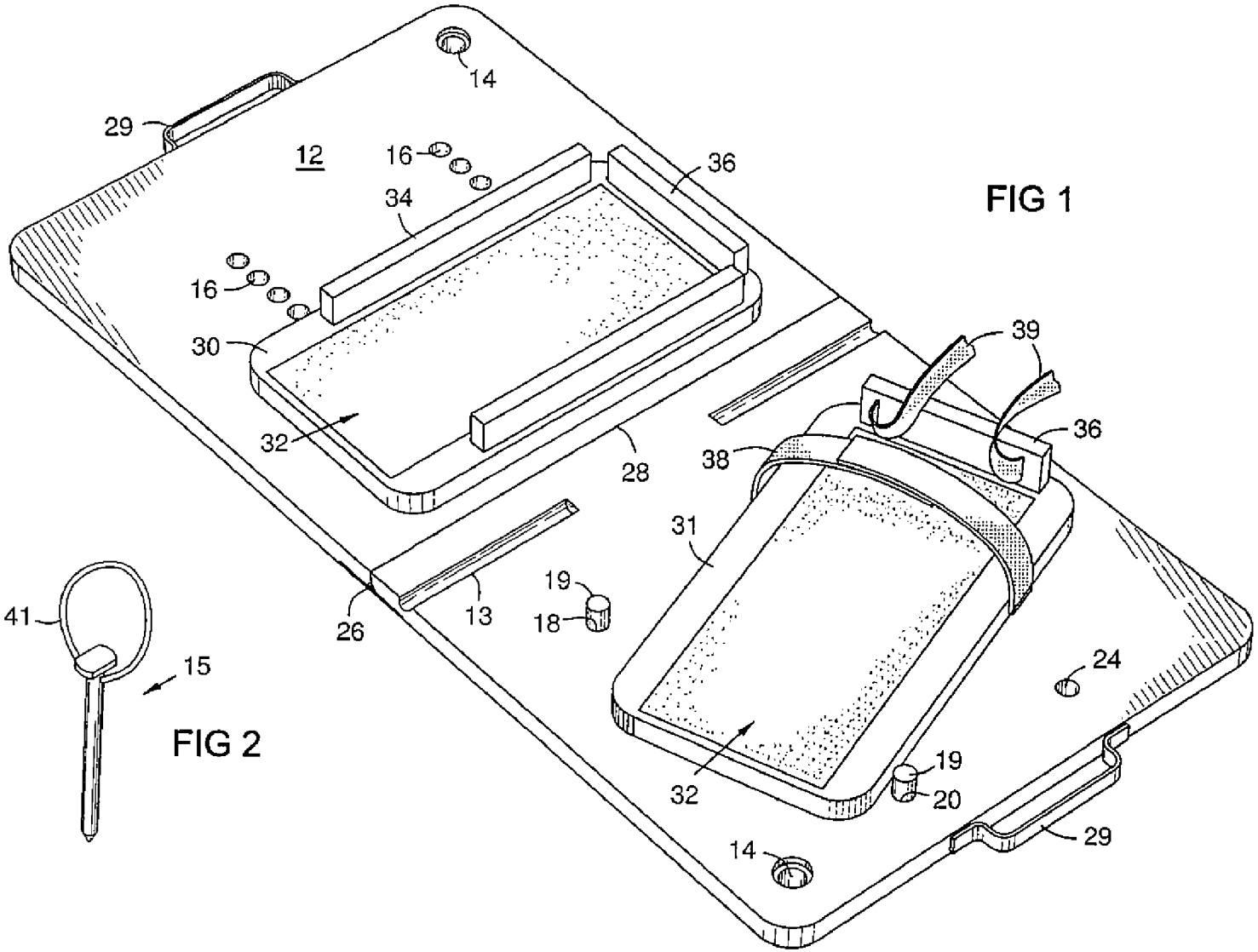
FIG. 1 is a perspective view of an embodiment of the invention
FIG. 2 is a perspective view of a ground anchor
Figure 3:
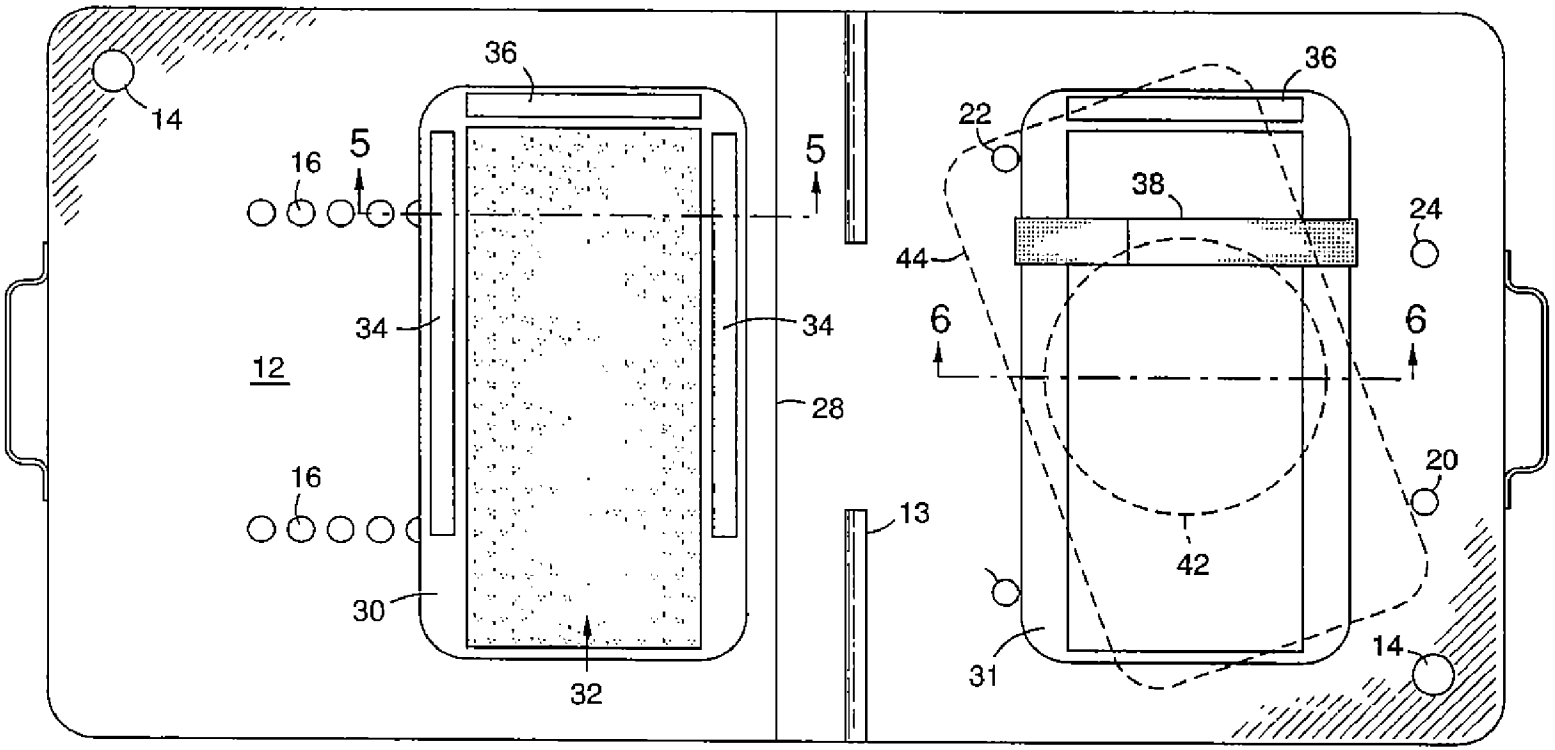
FIG. 3 is a top view of the embodiment of FIG. 1.

FIGS. 1 and 3 show a swiveled position 44 of the swivel plate 31 that occurs during a batter's swing. The swivel range is limited by swivel stops 18, 20, 22, 24 in the base plate. This prevents excess swiveling that overshoots the desired running position and could injure a user's ankle or knee. Two stop pegs 19 are inserted in a selected two of the stop holes 18, 20, 22, 24 depending on right or left-handed use. For a right-handed batter, swivel stop holes 18 and 20 are pegged. The peg in hole 18 stops the swivel plate 31 in alignment with the step plate 30 for the address stance. The peg in hole 20 stops the swivel during the swing. Swivel stop 20 provides a predetermined swivel angle such as 40 degrees. Optionally, a series of stop holes 20 (not shown) or another adjustable stop means (not shown) can be provided so the user can select a swivel angle within a range such as 20-90 degrees, for both hitting and bunting practice.

The step plate 30 is adjustably mounted so users know where and how to begin their address stance. This prevents them from starting with their feet too far apart. A series of stance width adjustment holes 16 may be provided on the base plate 12. The step plate 30 may have a bottom surface with mounting pegs 17 extending downward for insertion into selected adjustment holes 16 as in FIG. 5. This allows the step plate 30 to be mounted on the base plate in a position that provides a natural stance for the user, such as approximately shoulder width apart from the swivel plate 31.

Figure 7:
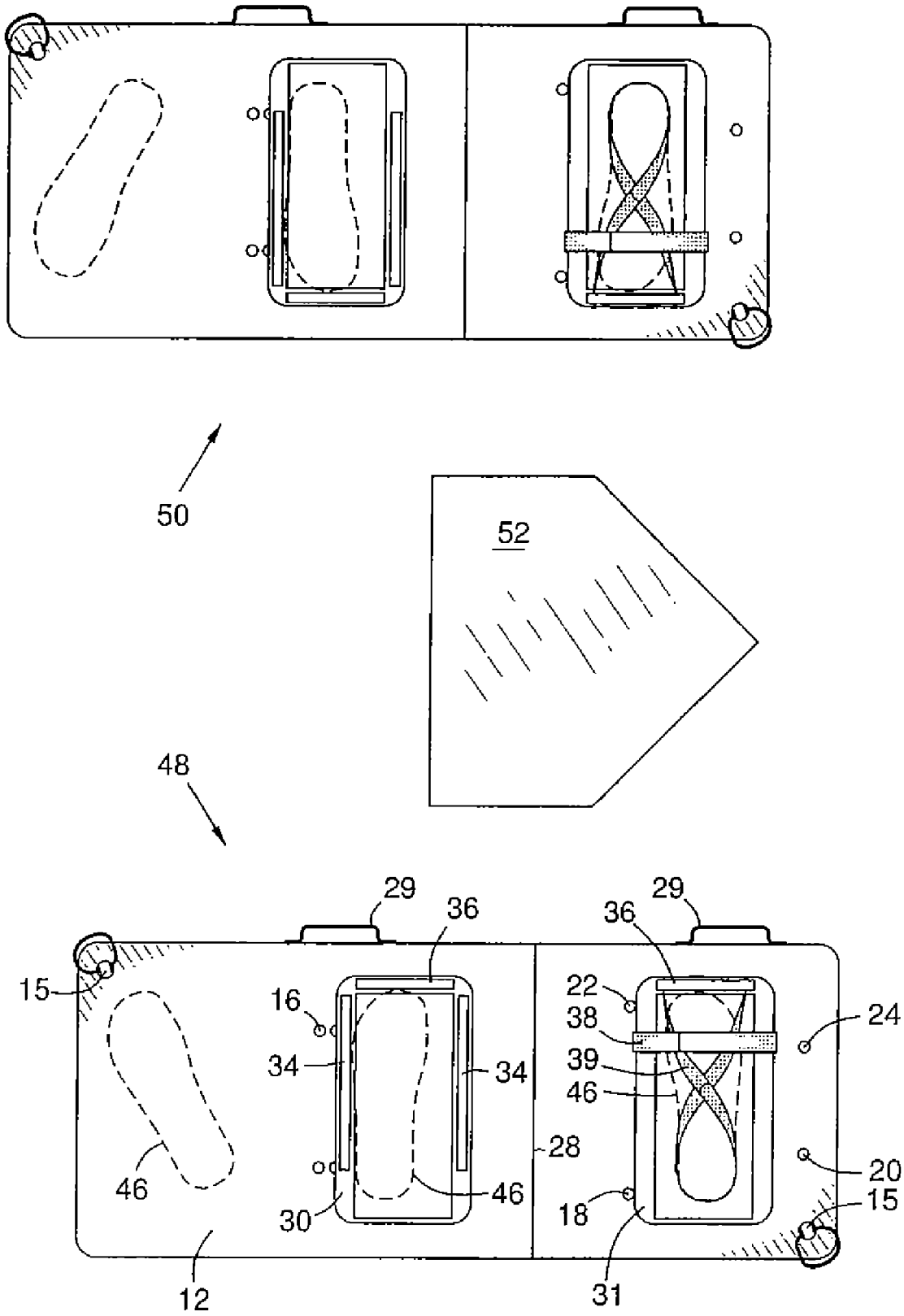
FIG. 7 is a top view of left and right-handed configurations of the device relative to a home plate, with an extended lead portion of base.

The length of the base plate(s) may be any selected length, with both halves being of equal or of unequal length as measured from the hinges. FIG. 7 shows a version of this device with a base 12 with one half that is larger in the forward direction. This extension provides extra space upon which the lead foot can step during the swing, as shown by footprints 46. The base may be asymmetric about the hinge 28, as shown in FIG. 7. Two handles 29 can be provided as shown that are equidistant from the hinge-line 28 at approximately a balance point when the base is folded. This brings the handles together in the folded position of the base for easy carrying, so that a latch is not needed to maintain the folded position. Alternatively, a single handle may be provided on one side of the base plate, and one or more latches may be provided to hold the two halves together in the carrying position. FIG. 7 shows a right-handed configuration 48 and left-handed configuration 50 of the device relative to a home plate 52.

To use this device a user puts her back foot, which is the foot furthest from the pitcher into the swivel plate 31 up to the toe stop 36. Then she adjusts the toe strap 38 across the foot, and adjusts the ankle strap 39 over the foot and around the ankle. This retains the foot on the swivel plate 31 while allowing the heel to rise during the swing. The user puts her lead foot on the step plate 30 with her toe against the toe stop 36 and the leading side of the foot against a foot guard 34. The user is now standing on the two plates with her feet aligned with each other as shown by footprints 46 of FIG. 7.

The user takes an address stance for swinging a bat at a pitched ball. The user steps forward towards the pitch, shifts body weight toward the pitch, lifts the back heel, and twists hips and shoulders toward the pitch, causing the swivel plate 31 to turn to its stop. Proper foot alignment is taught by placing one foot on the stepping plate 30 and one foot on the swivel plate 31. The user places each foot forward to the respective toe stop 36. This teaches the user to align the feet evenly. The front foot is placed against the forward-most foot guard so the foot is perpendicular to the pitch. The user's back foot is strapped on to the swivel plate with a toe strap across the toe area and an ankle strap around the ankle. The proper address stance width is important so the user does not overstep the swing. Stance width is set by adjusting the stepping plate 31 to the natural stance of the user by mounting the stepping plate pegs 17 in a selected pair of holes 16.

Once the user has proper placement of her feet on the stepping plate 30 and the swivel plate 31, she is ready to begin her swing. The user will step over the foot guard 34 on the stepping plate 30, causing her weight to shift forward toward the ball. This will happen naturally when she steps, since the base plate 12 is lower than the stepping plate. It is important for the user to learn to step forward and not to slide the front foot forward, in order to ensure proper weight shift to the front leg. The foot guard 34 requires the user to lift the front foot a predetermined distance to clear the foot guard 34, thus training the user not to slide the foot. The base can be made long enough to receive the lead foot after it steps forward off of the stepping plate. The user's back foot stays against the toe stop 36. The heel of the back foot is raised, shifting weight to the ball of the foot as the user turns the foot and the swivel plate 31.

This device is designed for practical manufacture. All plates 12, 30, and 31 can be fabricated from standard flat stock material using conventional machine tools or woodworking tools and methods, or they can be molded or otherwise formed. The step plate 30 and the swivel plate 31 can be formed in the same mold, including foot guards 34 on both plates, to reduce tooling cost. The materials for the construction of the various structural members of the device may be plastic, wood, metal, fiberglass, or other material having the required strength and preferably lightweight for easy portability. The peg holes 16, 18, 20, 22, 24 in the base plate may be lined with sleeves (not shown) to enable the pegs to be removed and replaced repeatedly without damaging the base plate 12.

Figure 4:
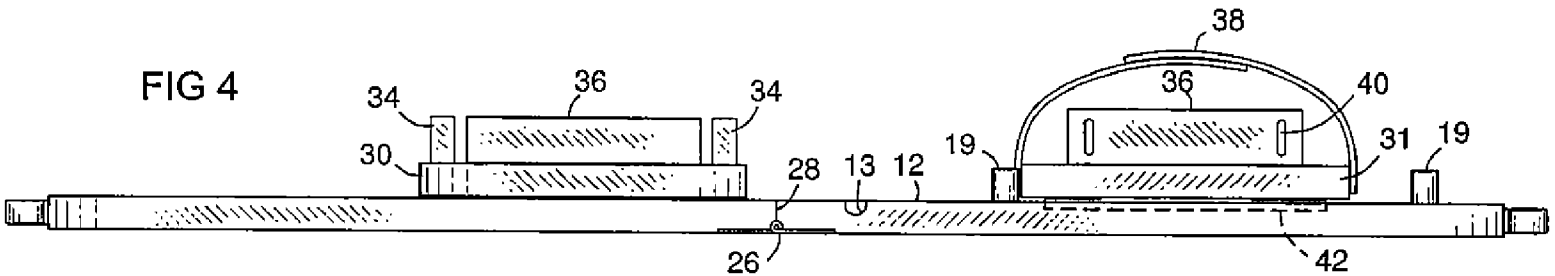
FIG. 4 is a side view of the embodiment of FIG. 1.

Holders for the anchors 15 may be provided on the base plate 12. For example, depressions 13 can be provided in the base 12 as shown in FIGS. 1, 3, and 4 to frictionally grip and hold the anchors in a stored position. Spring clips or other known holders can also be used. The anchors may have loops 41 as shown in FIG. 2 for easy manual pulling of the anchors from the ground. In this case, the anchors can be stored on the toe strap 38, without need for other holders.

The step plate 30 has two lateral adjustment pegs 17 on the bottom, a non-skid upper surface 32, a toe stop 36, and a raised foot guard 34 on each side. One foot guard 34 is used for right-handed hitters and the other is used for left-handed hitters. To convert between right and left-handed hitters the step plate 30 is lifted from the base 12, rotated 180 degrees, and reset in the adjustment holes 16.

The swivel plate 31 has a toe stop 31 with holes 40 for attaching the ankle strap 39. The toe strap 38 can be attached to the swivel plate as shown. Optionally two foot guards 34 can be provided on the swivel plate 31 as on the step plate 30 to prevent the back foot from slipping off the swivel plate 31. In this case, the toe strap 38 can be attached to the foot guards. To convert the swivel plate 31 between right-handed and left-handed hitters, the stop pegs 19 are removed, and the swivel plate is rotated 180 degrees, then the stop pegs 19 are placed into stop holes 18 and 20 for right-handed hitters or holes 22 and 24 for left-hand hitters. Optionally, the stop pegs 19 may be provided in the form of captured spring-loaded buttons in all of the stop holes 18, 20, 22, 24, that toggle between an extended and retracted position.

The toe and ankle straps 38, 39 may be made of leather, fabric, plastic, or other appropriate material. The two ends of each strap should have the capability of being joined together and loosened to facilitate insertion and removal of the foot. The clasp for the straps may be a buckle, VELCRO brand fastener, cinch strap with ring, quick release buckle or simply a tie or some other appropriate clasp. The ankle strap 39 may or may not be crossed over the top of the foot.

Figure 8:
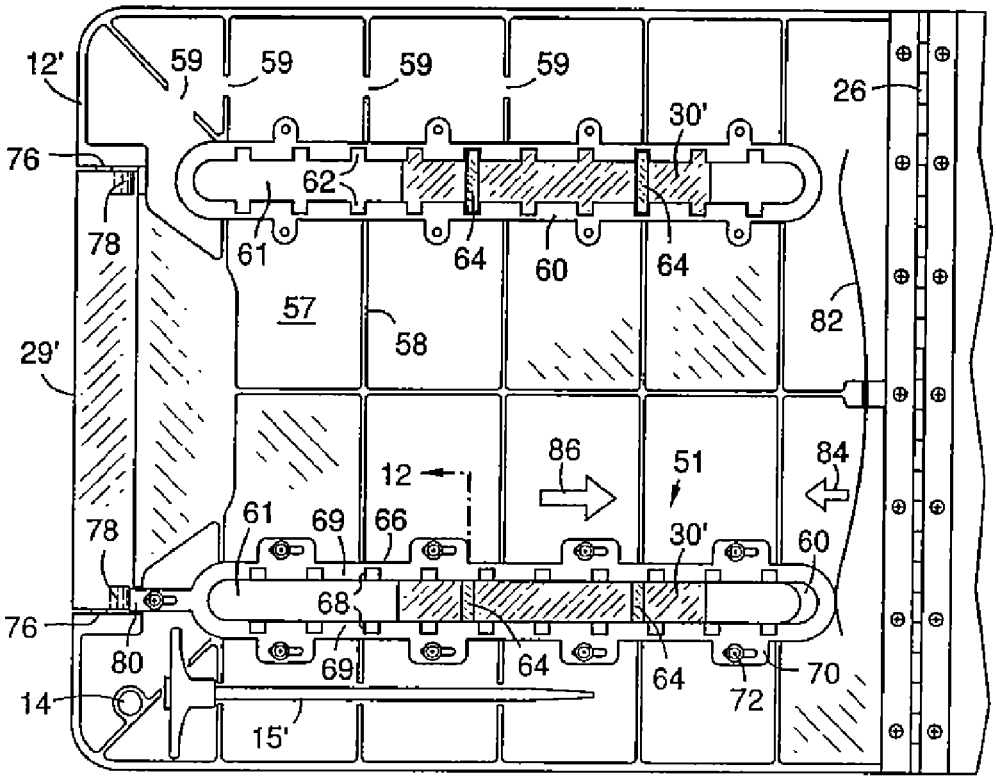
FIG. 8 is a partial bottom view of a second embodiment of the base plate showing a second type of step plate position adjustment mechanism in a locked position.
Figure 9:
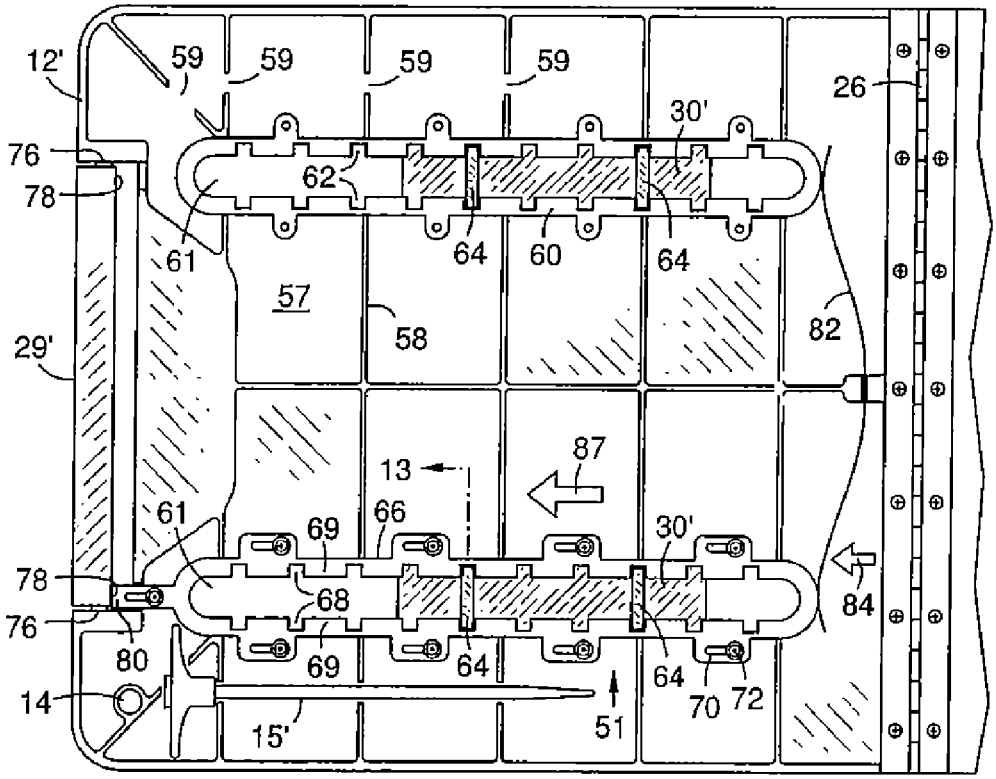
FIG. 9 is a partial bottom view as in FIG. 8 showing a releasing position of the step plate position adjustment mechanism.

FIGS. 8-13 illustrate an embodiment of the invention with a second type of selectable positioning mechanism for a step plate 30'. FIGS. 8 and 9 are bottom views of the part of the base plate 12' that supports the step plate 30'. The base plate 12' is shown formed as a shell 57 with reinforcing webbing 58. Gaps 59 in the webbing may be provided to retain ground anchors 15' when the two halves of the base plate 12' are folded together. Only one of the two anchors 15' is shown in FIGS. 8 and 9. The second anchor 15' is not shown, so that the gaps 59 can be seen in the upper part of each view. If the base plate 12' is solid, rather than webbed, a depression in the bottom of the base plate 12' in the shape of the anchor 15' may be provided for each anchor 15'. When the two halves of the base 12' are folded together the anchors 15' are enclosed between them.

Figure 10:
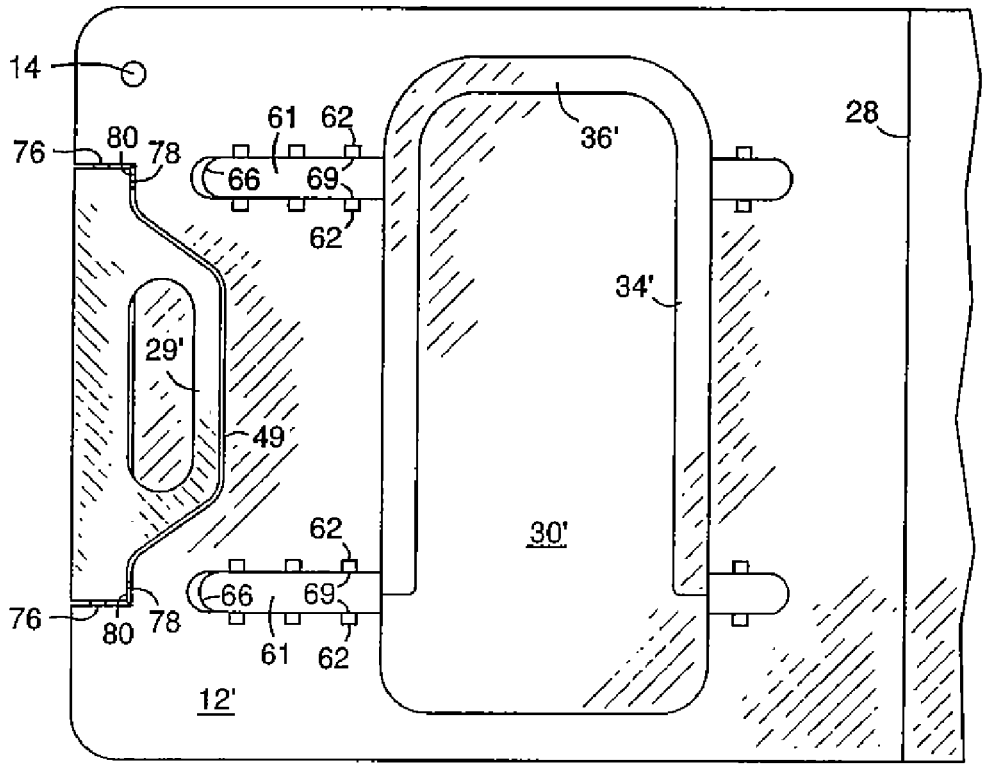
FIG. 10 is a partial top view of the second embodiment in a locked position.
Figure 11:
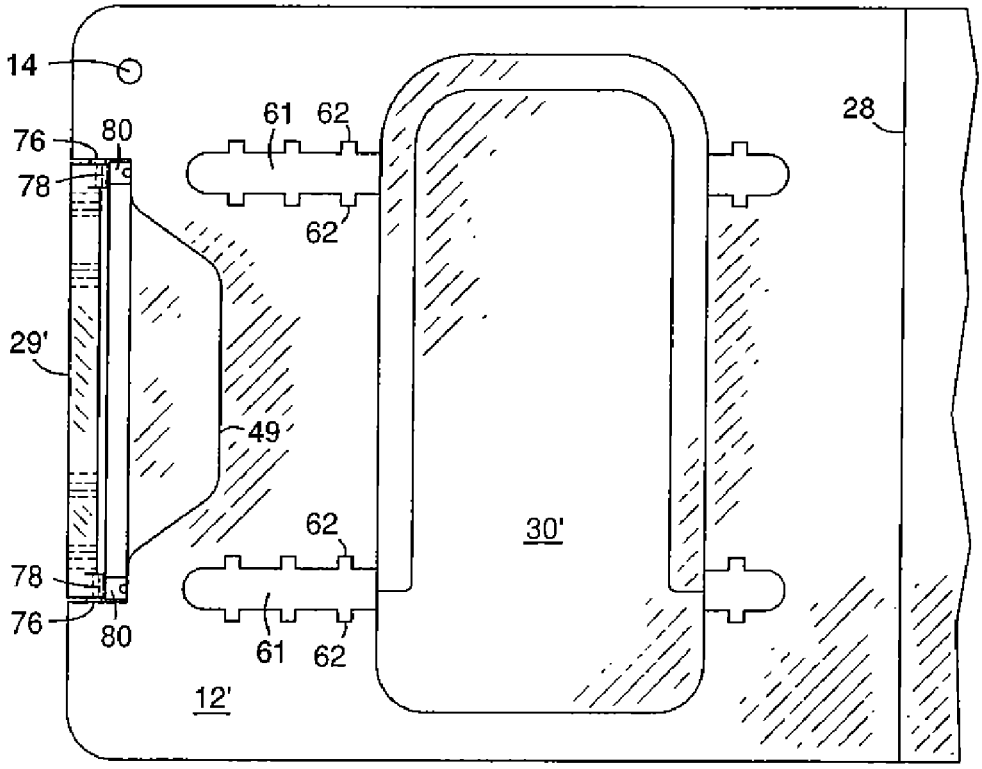
FIG. 11 is a partial top view of the second embodiment in a releasing position.
Figure 12:
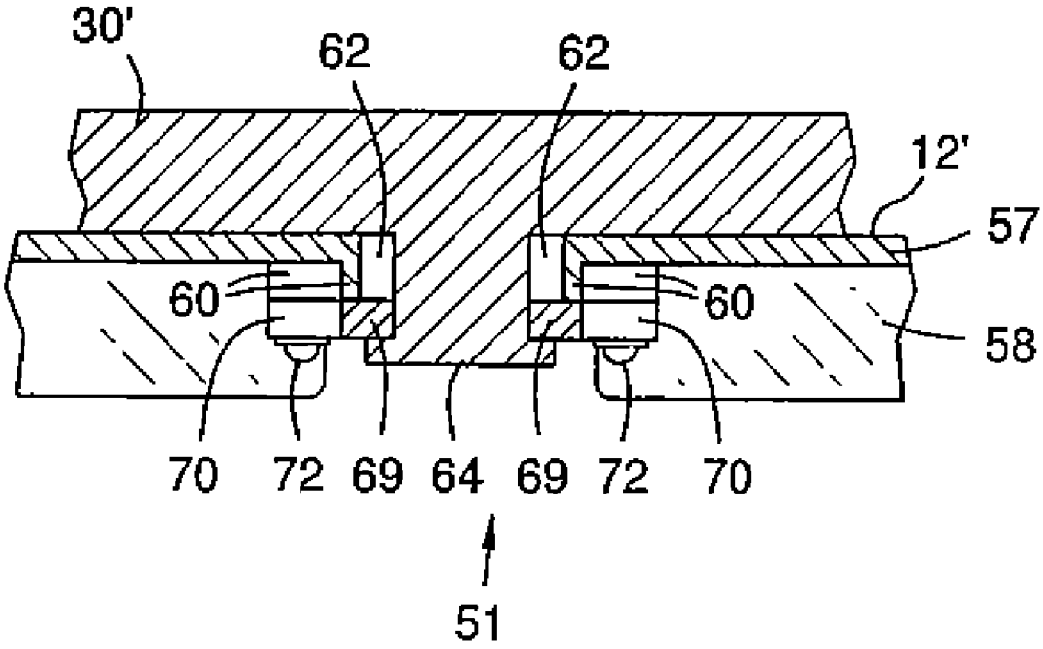
FIG. 12 is a partial sectional view taken on line 12 of FIG. 8.
Figure 13:
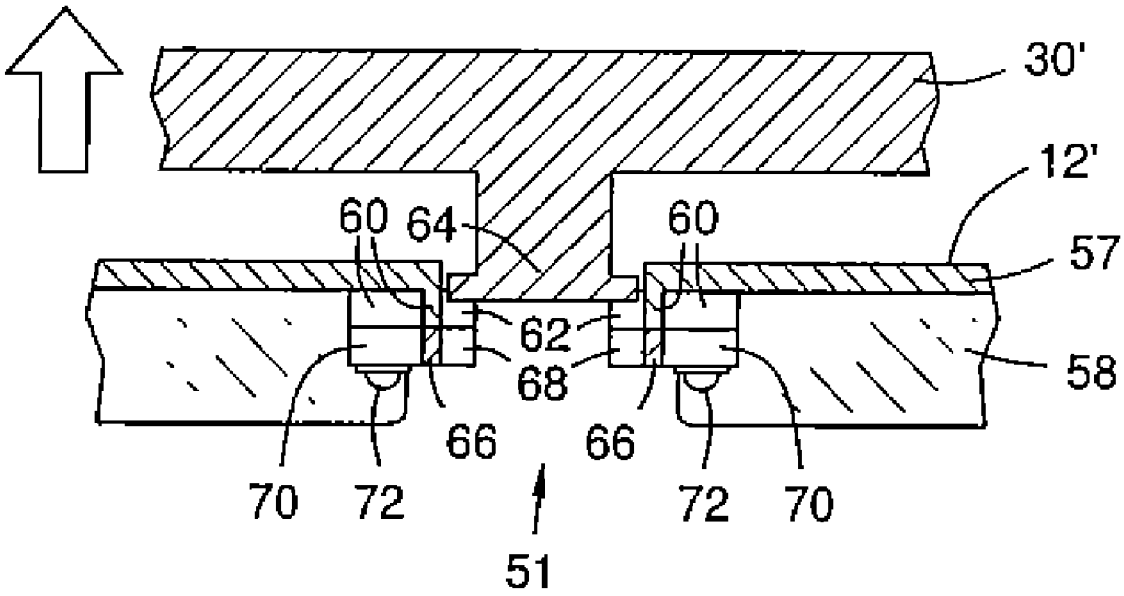
FIG. 13 is a partial sectional view taken on line 13 of FIG. 9.

FIGS. 8-13 show a locking mechanism 51 for the step plate 30' including two parallel elongated slots 61 in a top plate portion 60 of the base plate 12' with rows of keyways 62. One or more keys 64 extend downward from the bottom of the step plate 30' as shown in FIGS. 12-13 for insertion into a selected keyway 62. Alternately the keyways 62 can be discrete holes without an elongated slot 61. A locking plate 66 is slidably disposed under the top plate 60, and has an alternating plurality of grooves 68 and tongues 69. Only one of the two locking plates 66 is shown in FIGS. 8 and 9 so that a top plate 60 and its keyways 62 are visible on the upper part of each view. When the locking plate 66 is in a release position as in FIGS. 9, 11, and 13 the grooves 68 are aligned with respective keyways 62 for admitting a key 64 through a selected keyway 62. When the locking plate 66 is in a locked position as in FIGS. 8, 10, and 12 the tongues 69 are slidably positioned covering the keyways 62, thus blocking removal of the key 64 from the selected keyway 62. When the keyways 62 in the top plate 60 and the grooves 68 in the locking plate 66 are aligned as in FIGS. 9, 11, and 13, the step plate 30' can be removed from, or installed in, the base plate 12', as shown in FIG. 13. The locking plate 66 may be slidably mounted on the base plate 12' by means of slotted bosses 70 and retainer screws 72. When the locking plate 66 is moved from the releasing position of FIGS. 9, 11, and 13, the tongues 69 block the keyways 62 as shown in FIGS. 8, 10, and 12, fixing the step plate 30' to the base plate 12'.

To control the locking plates 66 a lever 29' may be mounted pivotally on the base plate 12' in an indentation 49 in the base plate via journals 76. A cam surface 78 operates against a follower end 80 of each locking plate 66. A spring 82 urges 84 the locking plate 66 against the cam surface 78 at all times. When the lever 29' is inwardly rotated as in FIGS. 8 and 10 it nests in the indentation 49, and is flush with the top of the base plate 30'. In this position the cam surfaces 78 urge 86 the locking plates 66 toward the spring 82. This locks the keys 64 of the step plate 30' into the base plate 12'. In this position the invention is usable for batting practice and for carrying. A generally flat portion on each cam surface 78 may be provided just past a maximum radius of the cam surface 78 to provide a detent for the handle rotation as known in cam design, so that the lever 29' is stable in the flush position of FIG. 10. When the lever 29' is rotated upward as in FIGS. 9 and 12, the cam surfaces 78 recede. The spring 82 maintains 87 the locking plates 66 against the cam surfaces 78. The cams are designed to bring the keyways 62 and grooves 68 into alignment at a rotational stopping point of the lever 29'. The rotation range of the lever 29' is shown as 90°, but may be another range. The step plate 30' can then be removed from the base plate 12' as in FIG. 13 and moved to another position.

Figure 14:
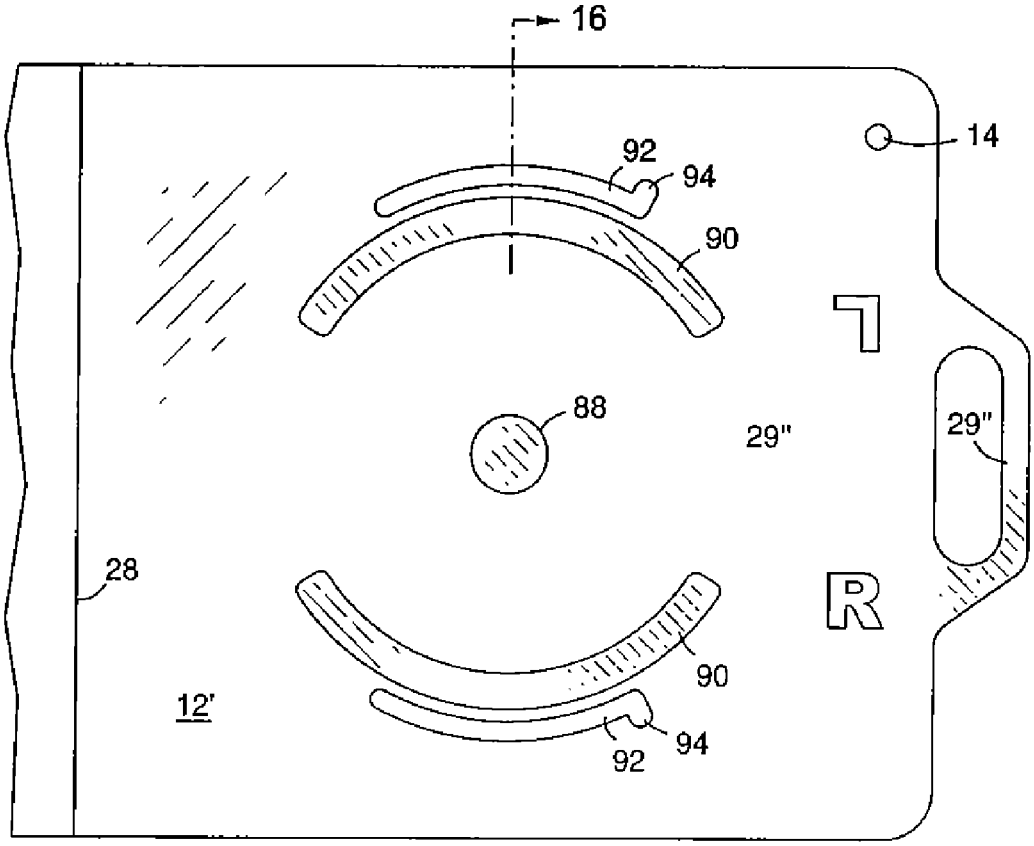
FIG. 14 is a top view of the portion of the base plate that supports the swivel plate in the second embodiment.
Figure 15:
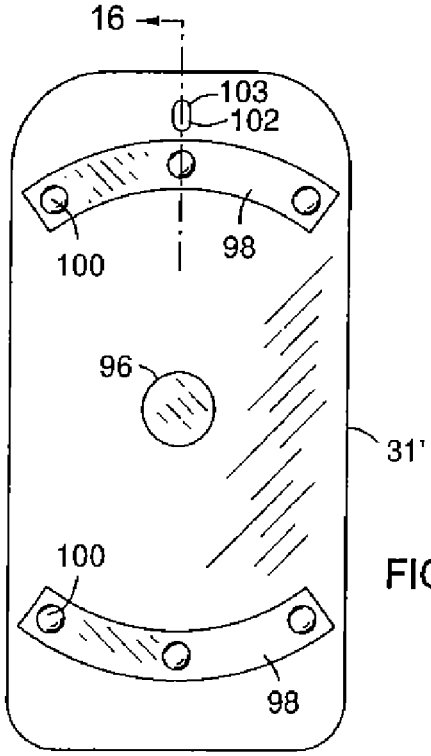
FIG. 15 is a bottom view of a swivel plate in the second embodiment.
Figure 16:
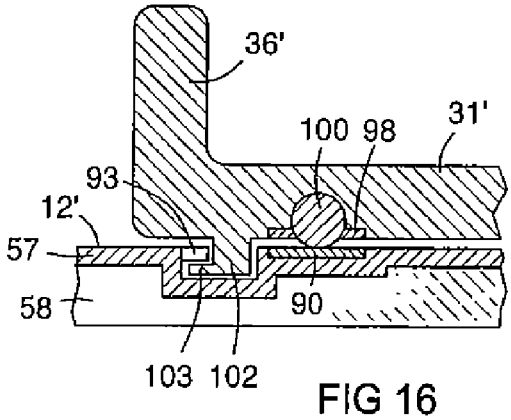
FIG. 16 is a partial sectional view taken on line 16 of FIGS. 14 and 15 when the swivel plate is mounted on the base plate.

FIGS. 14-16 illustrate an embodiment of the invention with a second type of bearing mechanism for a swivel plate 31'. FIG. 14 shows a top view of the part of the base plate 12' that supports the swivel plate 31'. It has with an axle opening 88, two races 90, and two arcuate keyways 92 with enlarged regions 94. The races 90 may be for example metal inserts in the top surface of the base plate 12'. FIG. 15 shows a bottom view of a swivel plate 31' with an axle 96 to be inserted in the axle opening 88, two bearing retainers 98 with rollers 100, and a support key 102 to be inserted in one of the arcuate keyways 92, depending on left or right orientation. Each support key 102 has a lip 103 that is retained under a lip 93 of each arcuate keyway 92, preventing the swivel plate 31' from falling off of the base plate 12' in a carrying position. The swivel plate 31' as shown is heavier at the toe end about its axis of rotation due to the toe stop 36'. Thus, in the carrying position, the toe end of the swivel plate 31' rotates by gravity to the low end of the arcuate keyway 92. This moves the support key lip 103 away from the enlarged region 94, thus retaining the swivel plate 31' on the base plate 12'. A carrying handle 29" is shown in FIG. 14.

While various embodiments of the present invention have been shown and described herein, it will be obvious that such embodiments are provided by way of example only. Numerous variations, changes and substitutions may be made without departing from the invention as claimed herein.

The invention claimed is:

1. A swing training device comprising:

a base;

a swivel plate rotatably attached to the base, the swivel plate comprising a back foot positioning structure comprising a toe stop for positioning a user's back foot in an address position, the swivel plate rotatable relative to the base as the user's back foot moved from its address position to a swinging position;

a step plate securably attachable to the base in any of a plurality of positions relative to the swivel plate in response to a size of the user, the step plate comprising a front foot positioning structure comprising a toe stop for positioning the user's front foot in an address position;

the front foot positioning structure comprising a foot guard comprising a height over which the user must lift the front foot to move the front foot from its address position to a swinging position;

the step plate comprising a bottom surface for contacting the base and a key extending from the bottom surface;

the base comprising a plurality of keyways for alternatively receiving the key when the step plate is positioned on the base in alternative ones of the plurality of positions;

a locking mechanism for selectively securing the key in any selected one of the keyways;

the base comprising a top plate comprising the keyways formed there through; and the locking mechanism comprising a locking plate slidably disposed under the top plate and comprising an alternating plurality of grooves and tongues, the grooves being aligned with respective keyways for receiving the key when the locking mechanism is in a release position and the tongues being slidably positioned to be in alignment with the keyways for blocking the removal of the key from the selected keyway when the locking mechanism is in a locked position.

2. The swing training device of claim 1, further comprising:

a spring biasing the locking mechanism toward the locked position; and a lever associated with the locking mechanism and selectively positionable by the user to alternatively move the locking mechanism between the locked and release positions.

3. The swing training device of claim 1, wherein the swivel plate and the step plate are each reversible 180 degrees to convert the swing training device between right and left-handed use.

4. The swing training device of claim 1, wherein the base is divided into two parts along a transverse hinge line approximately midway along a length of the base, the two parts of the base connected by a hinge for folding of the swing training device; and further comprising a handle on a periphery of the base for carrying the device in a folded condition.

5. The swing training device of claim 1, further comprising a foot retainer on the swivel plate that allows the heel of a user's foot on the swivel plate to rise, comprising an adjustable ankle strap attached to the toe end of the swivel plate, and an adjustable toe strap attached to the swivel plate.

6. The swing training device of claim 1, further comprising:

at least two ground anchors insertable through holes in the base for securing the device to the ground when in use; and depressions formed in the base for receiving the ground anchors into a storage position.

7. A method of using the swing training device of claim 1 comprising:

adjusting the distance of the step plate from the swivel plate to a desired address stance for the user;

the user placing the front foot onto the step plate into the address position with a toe end of the front foot against the step plate toe stop;

the user placing the back foot onto the swivel plate into the address position with a toe end of the back foot against the swivel plate toe stop; and the user swinging a ball-striking implement while lifting the front toot over the foot guard and stepping the front foot forward to the swinging position and while pivoting the swivel plate to the swinging position with the back foot.

8. A swing training device comprising:

a base:

a swivel plate rotatably attached to the bass, the swivel plate comprising a back foot positioning structure comprising a toe stop for positioning a user's back foot in an address position, the swivel plate rotatable relative to the base as the user's back foot is moved from its address position to a swinging position;

step plate securably attachable to the base in any of a plurality of positions relative to the swivel plate in response to a size of the user, the step plate comprising a front foot positioning structure comprising a toe stop for positioning the users front foot in an address position;

the front foot positioning structure comprising a foot guard comprising a height over which the user must lift the front foot to move the front foot from its address position to a swinging position;

the swivel plate comprising a bottom surface, an axle protruding below the bottom surface, rollers disposed on opposed sides of the axle and protruding below the bottom surface; and a support key extending below the bottom surface;

the base comprising an opening receiving the axle for rotation therein, a top surface for contacting the rollers during rotation of the swivel plate on the base, and an arcuate keyway for sliding engagement with the support key as the swivel plate is rotated, with cooperation between the support key and the keyway maintaining the swivel plate in position on the base during transportation of the device; and the keyway comprising an enlarged region for allowing engagement and disengagement of the support key with the keyway for alternatively attaching and separating the swivel plate and the base.

* * * * *